US006308412B1

(12) United States Patent
Christofaro et al.

(10) Patent No.: US 6,308,412 B1
(45) **Date of Patent: *Oct. 30, 2001**

(54) JOINT BETWEEN CROSS MEMBER AND SIDE RAIL IN A VEHICLE FRAME ASSEMBLY

(75) Inventors: Paul A. Christofaro; Mark W. Kiehl, both of Reading, PA (US)

(73) Assignee: Dana Corporation, Toledo, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/001,858

(22) Filed: Dec. 31, 1997

(51) Int. Cl.[7] ..... B21D 53/88
(52) U.S. Cl. ..... 29/897.2; 29/421.1
(58) Field of Search ..... 280/796, 795; 29/897.2, 897.3, 897.312, 421.1, 428, 897; 72/58, 61, 62; 228/177, 178

(56) References Cited

U.S. PATENT DOCUMENTS

| | | | | |
|---|---|---|---|---|
| 1,846,567 | * | 2/1932 | Murray, Jr. | 280/106 |
| 1,893,721 | * | 1/1933 | Wahlberg | 280/106 |
| 2,009,963 | * | 7/1935 | Matthaei | 280/106 |
| 2,107,382 | * | 2/1938 | Maddock | 280/106 |
| 2,113,403 | * | 4/1938 | Harmon | 280/106 |
| 2,168,436 | * | 8/1939 | Bruss | 20/106 |
| 2,173,525 | * | 9/1939 | Wallace | 280/106 |
| 2,174,922 | * | 10/1939 | Kuiper | 280/106 |
| 2,192,560 | * | 3/1940 | Riemenschneider | 29/152 |
| 2,194,349 | * | 3/1940 | Almdale | 280/106 |
| 2,222,929 | * | 11/1940 | Almdale | 280/106 |
| 2,344,378 | * | 3/1944 | Wagner | 280/106 |
| 2,701,726 | | 2/1955 | Barenyi . | |
| 2,941,568 | | 6/1960 | Ottestad et al. . | |
| 3,487,668 | | 1/1970 | Fuchs, Jr. . | |

FOREIGN PATENT DOCUMENTS 691329 5/1953 (GB) .

* cited by examiner

*Primary Examiner*—I Cuda Rosenbaum
*Assistant Examiner*—T. Nguyen
(74) *Attorney, Agent, or Firm*—MacMillan, Sobanski & Todd, LLC

(57) ABSTRACT

A method of manufacturing a vehicle frame assembly includes the initial steps of providing first and second side rails and providing first and second cross members. Each of the first and second cross members has first and second ends extending from a central portion. A desired torsional stiffness is determined for the first cross member. In response to this determination, the first and second ends of the first cross member are enlarged so as to achieve the desired torsional stiffness for the cross member. A similar process can be conducted for the second cross member. Then, the first ends of the first and second cross members are secured to the first side rail, and the second ends of the first and second cross members are secured to the second side rail to form a vehicle frame assembly.

14 Claims, 10 Drawing Sheets

JOINT BETWEEN CROSS MEMBER AND SIDE RAIL IN A VEHICLE FRAME ASSEMBLY

BACKGROUND OF THE INVENTION

This invention relates in general to vehicle frame components and in particular to an improved structure for a joint between a cross member and a side rail in a vehicle frame assembly, wherein the cross member has ends that are circumferentially enlarged relative to a central portion thereof, and wherein the enlarged ends extend to or through the side rail of the frame assembly.

Virtually all land vehicles in common use, such as automobiles and trucks, include a frame which serves as a platform upon which the remainder of the vehicle is built. Many vehicle frame structures are known in the art. Most of these known vehicle frame structures are formed from a number of individual metallic components which are permanently joined together. For example, a typical full perimeter vehicle frame assembly includes a pair of longitudinally extending side rails which are joined together at the front by a forward cross member, at the rear by a rearward cross member, and at intermediate locations by one or more intermediate or auxiliary cross members. The cross members not only connect the two side rails together, but also provide desirable lateral, vertical, and torsional rigidity to the vehicle frame assembly. In some vehicle frame assemblies, the side rails are formed from open channel structural members, i.e., structural members which have a non-continuous cross sectional shape (U-shaped or C-shaped channel members, for example). In other vehicle frame assemblies, the side rails are formed from closed channel structural members, i.e., structural members which have a continuous cross sectional shape (box-shaped or tubular channel members, for example). Regardless of the specific structure of the structural members, the side rails and cross members, once joined together, form a rigid frame for supporting the remaining portions of the vehicle thereon.

Typically, the cross members extend transversely relative to the two parallel side rails, and the ends of the cross members are permanently secured to the side rails at joints to form a generally rectangular vehicle frame assembly. In some instances, the joints between the cross members and the side rails are sufficiently strong that the ends of the cross members can be secured directly to the side rails, such as by welding, rivets, bolts, and the like. In other instances, the ends of the cross members are connected by brackets or similar reinforcing structures to the side rails. In these latter instances, it has been found that the use of such additional brackets or similar reinforcing structures adds undesirable cost and complexity to the vehicle frame assembly. Thus, it would be desirable to provide an improved structure for a joint between a cross member and a side rail in a vehicle frame assembly that eliminates the need for such brackets or similar reinforcing structures.

SUMMARY OF THE INVENTION

This invention relates to an improved structure for a joint between a cross member and a side rail in a vehicle frame assembly that eliminates the need for brackets or similar reinforcing structures to increase the strength thereof. The vehicle frame assembly includes a pair of longitudinally extending side rails and having at least one cross member extending transversely therebetween. The side rails are hollow members including inner and outer side walls. The ends of the cross member are enlarged circumferentially relative to a central portion thereof. Each of the enlarged ends extends to or through the side rail of the frame assembly and is secured thereto. In a first embodiment, the enlarged ends of the cross member extend through both the inner and outer walls of the side rails and are secured thereto, such as by welding. In a second embodiment, the enlarged ends of the cross member extend through only the inner walls of the side rail and are secured thereto, such as by welding. In a third embodiment, the enlarged ends of the cross member are disposed adjacent to the inner walls of the cross member and secured thereto, such as by welding.

Various objects and advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
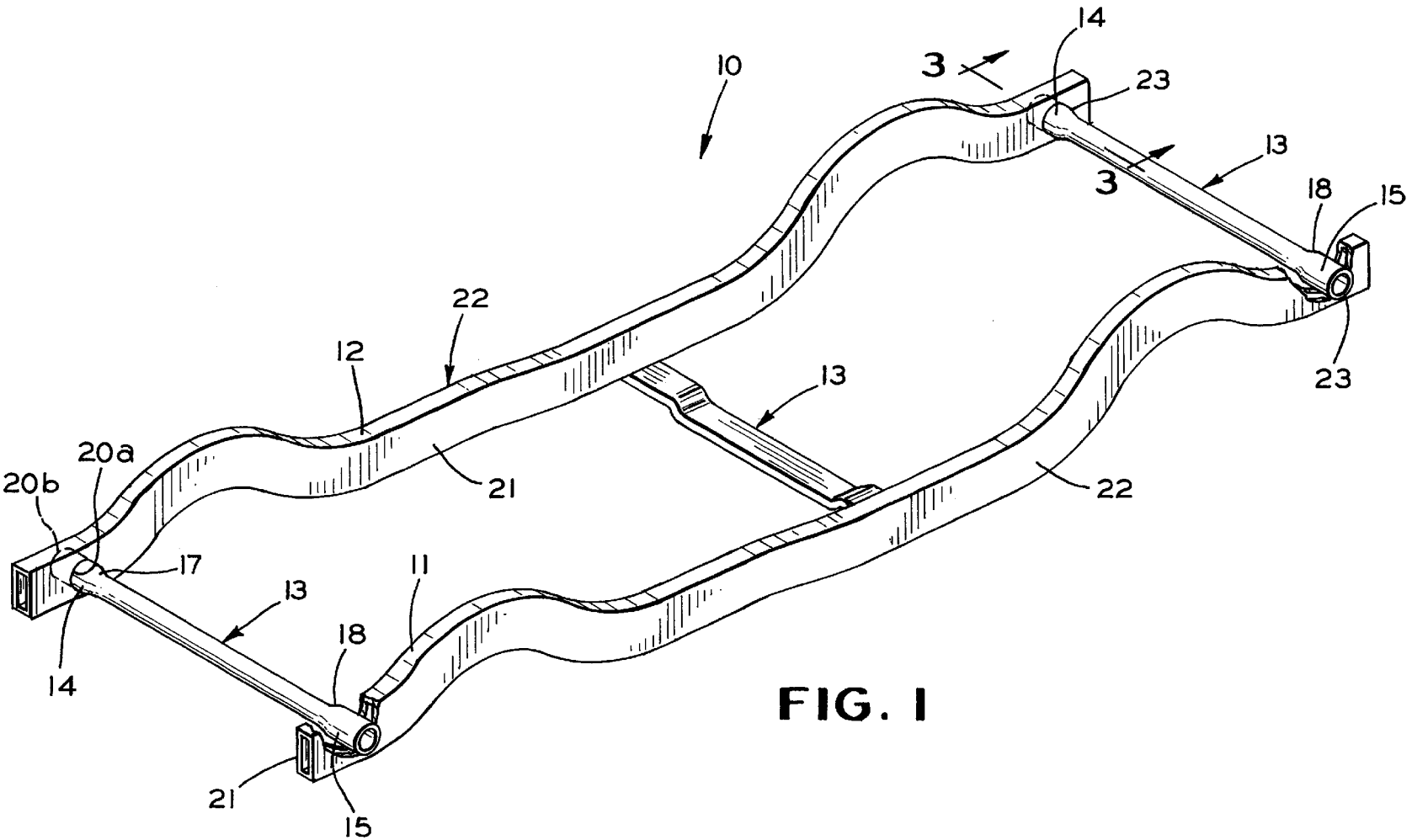
FIG. 1 is a perspective view of a portion of a full perimeter or ladder type vehicle frame assembly in accordance with this invention.

Referring now to the drawings, there is illustrated in FIG. 1 a portion of a full perimeter or ladder type vehicle frame assembly, indicated generally at 10, in accordance with this invention. The illustrated vehicle frame assembly 10 includes two longitudinally extending side rails 11 and 12. As is well known, the side rails 11 and 12 preferably extend throughout most or all of the length of the vehicle. However, it is also known to provide side rails 11 and 12 that extend throughout only a portion of the length of the vehicle. Each of the side rails 11 and 12 is preferably formed from a single relatively long piece of material. Alternatively, each of the side rails 11 and 12 may be formed from two or more relatively short pieces of material that are secured together in a conventional manner, such as by welding.

Figure 3:
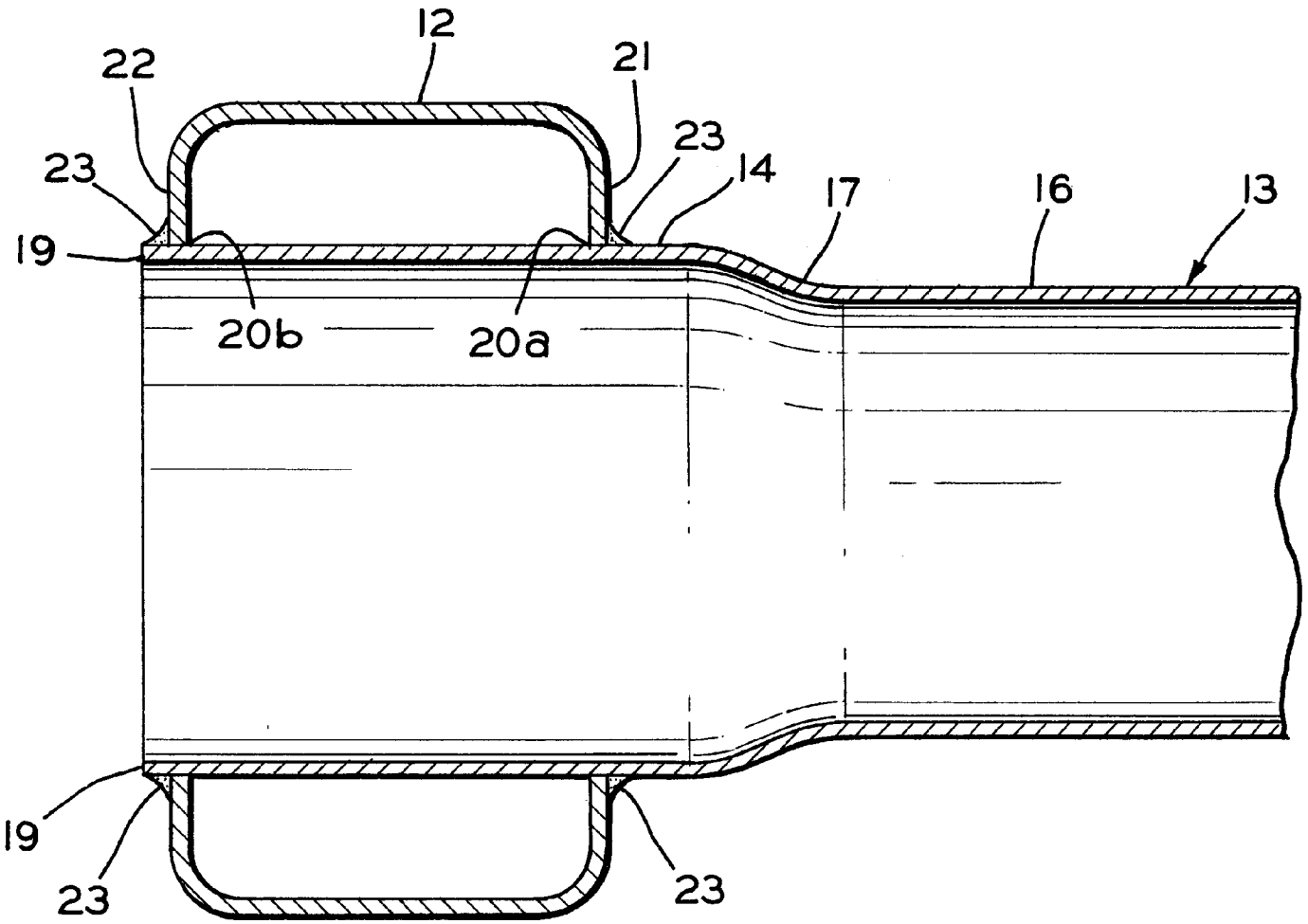
FIG. 3 is a sectional elevational view of a first embodiment of a joint between the cross member and the side rail illustrated in FIG. 1.

The illustrated side rails 11 and 12 are hollow members having a generally rectangular or box-shaped cross sectional shape, as best shown in FIG. 3. Thus, the illustrated side rails 11 and 12 each have an inner wall 21 and an outer wall 22. This cross sectional shape is advantageous not only because it provides strength and rigidity, but also because it provides vertically and horizontally oriented side surfaces that facilitate the attachment of various brackets and mounts (not shown) used to support other components of the vehicle on the vehicle frame structure 10. In the illustrated embodiment, the side rails 11 and 12 are formed from closed channel stock having a tubular or rectangular cross sectional shape. However, the side rails 11 and 12 may be formed from two pieces of U-shaped or C-shaped stock that are oriented so as to face inwardly toward one another and are secured together in a conventional manner, such as by welding. Typically, the side rails 11 and 12 are formed from steel or other suitable metallic materials. However, other materials, such as aluminum, composites (such as fiber matrix composites) or combinations thereof, may be used and shaped as desired using alternative methods, such as extrusion or pultrusion.

If tubular stock is used to form the side rails 11 and 12, the tubular stock may be formed into a desired shape in any conventional manner. For example, hydroforming may be used to form the side rails 11 and 12 to have the illustrated generally rectangular cross sectional shape. Hydroforming is a well known process that uses pressurized fluid to deform, expand, or re-shape a tubular member into a desired shape. In a known high pressure hydroforming process, the tubular member is initially disposed between two die sections of a hydroforming apparatus which, when closed together, define a die cavity having a desired final shape. Although the die cavity is usually somewhat larger than the tubular member itself and non-circular in cross sectional shape, the closure of the two die sections may, in some instances, cause some mechanical deformation of the tubular member. Thereafter, the tubular member is filled with a pressurized fluid, typically a relatively incompressible liquid such as water. The pressure of the fluid is increased to a magnitude where the tubular member is expanded outwardly into conformance with the die cavity. As a result, the tubular member is expanded into the desired final shape. In a known low pressure hydroforming process, the tubular member is initially filled with fluid at a relatively low pressure. Then, the tubular member is disposed between two die sections of a hydroforming apparatus which, when closed together, define a die cavity having a desired final shape. The closure of the two die sections causes deformation of the tubular member to as to conform with the die cavity. As a result, the tubular member is re-shaped into the desired final shape. It should be noted that the sequence of steps in either of the hydroforming processes may vary from that specifically described herein.

One or more cross members, indicated generally at 13, extend transversely between the side rails 11 and 12 to form the vehicle frame assembly 10 upon which the remainder of the vehicle is supported. In the illustrated embodiment, three of such cross member 13 are extend transversely at the front, center, and rear portions of the vehicle frame assembly 10. However, any desired number of cross members 13 may be provided. Each of the cross members 13 is preferably formed from a single relatively long piece of material that extends completely between the side rails 11 and 12. Alternatively, the cross members 13 may be formed from two or more relatively short pieces of material that are secured together in a conventional manner, such as by welding.

Figure 2:
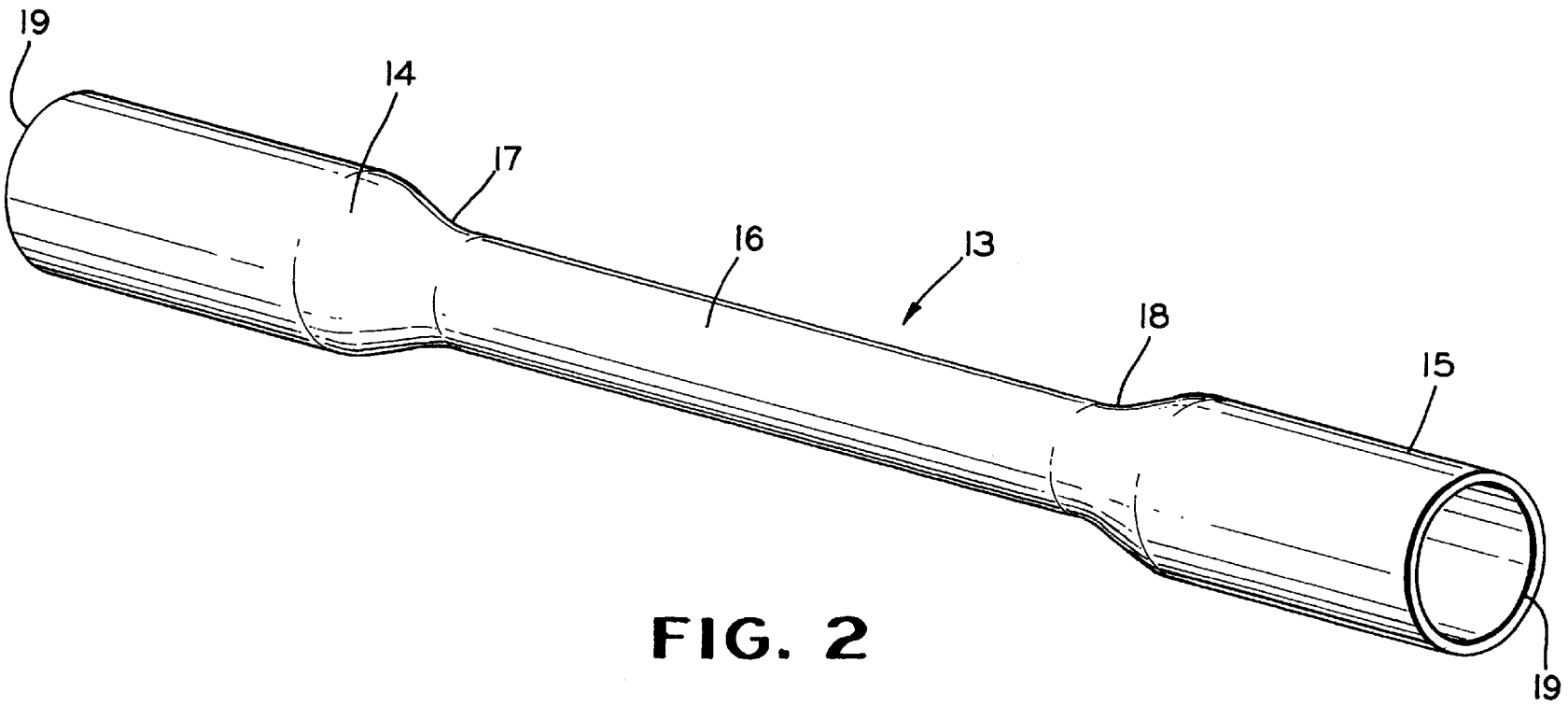
FIG. 2 is a perspective view of one of the cross members illustrated in FIG. 1.

Referring now to FIGS. 2 and 3, it can be seen that the front and rear cross members 13 are hollow members having a generally circular cross section. Although the illustrated cross members 13 have a generally circular cross section, it will be appreciated that the cross members 13 may be formed to have any desired cross sectional shape, such as square, rectangular, or polygonal. Each of the cross members 13 is formed having a pair of ends 14 and 15 that are somewhat larger in dimension than a central portion 16 thereof In the illustrated embodiment, the central portion 16 has a relatively constant diameter, although such is not necessary. The outer diameter of the cross member 13 increases in transition regions 17 and 18 extending respectively between the ends of the central portion 16 and the two enlarged ends 14 and 15 of the cross member 13. Preferably, the transition areas 17 and 18 taper gradually from the ends of the central portion 16 and the enlarged ends 14 and 15 of the cross member 13. The enlarged ends 14 and 15 of the cross member 13 terminate in respective outer edges 19. In the illustrated embodiment, the enlarged ends 14 and 15 have a relatively constant diameter, although again such is not necessary.

In the embodiment illustrated in FIG. 3, the outer dimension (the outer diameter in the illustrated cross member 13 having a circular cross sectional shape) of the enlarged ends 14 and 15 is maximized in response to several factors. One factor is the size of the inside wall 21 and the outside wall 22 of the side rails 11 and 12. As is known in the art, sufficient surface area should be left on the inside wall 21 and/or the outside wall 22 of the side rails 11 and 12 to provide structural support and an area to secure the cross member 13 thereto, as will be explained below. Another factor is the size of the enlarged ends 14 and 15 which may, in turn, be limited by the size and clearances of other vehicle components which are adjacent the cross member 13 or to the side rails 11 and 12. For example, if the central portion 16 has a outer circumference of about 3.00 inches, the circumference of the ends 14 and 15 could be about 3.75 inches. Preferably, the enlarged ends 14 and 15 are formed using a hydroforming process. Alternatively, other manufacturing methods which are known to those skilled in the art may be used to form a cross member 13 having ends 14 and 15 which are enlarged circumferentially relative to a central portion 16 thereof.

This invention contemplates that several cross member to side rail attachment configurations may be used to provide sufficient attachment or joint strength. In general, joint strength includes structural performance characteristics, such as stress distribution and magnitude, stiffness, and fatigue performance. In the first embodiment shown in FIG. 3, the enlarged end 14 of the cross member 13 extends through a pair of openings 20*a* and 20*b* formed through the inner wall 21 and the outer wall 22 of the side rail 12. Similarly, the enlarged end 15 of the cross member 13 extends through a pair of openings (not shown) formed through the inner wall 21 and the outer wall 22 of the other side rail 11. If the cross member 13 is generally straight as shown, the openings 20*a* and 20*b* formed through the side rail 12 will be generally transversely aligned with the openings formed through the side rail 11. Alternatively, the cross member 13 may have a bend (not shown) formed therein such that it is does not extend generally straight In that instance, the openings 20*a* and 20*b* formed through the side rail 12 may be transversely offset from the openings formed through the side rail 11.

The openings 20*a* and 20*b* are shaped to correspond to the cross sectional shape of the enlarged ends 14 and 15 of the cross members 13 and are slightly larger in size. Generally, the size of the enlarged ends 14 and 15 is maximized, while taking into consideration limitations associated with the manufacturing process and the size of the side rails 11 and 12. In a preferred embodiment, the cross members 13 are formed using a hydroforming process. Using this type of manufacturing process, the enlarged ends 14 and 15 of a particular cross member 13 may have an outer size in the range of from about 5% to about 50% larger than the outer size of the central portion 16 thereof.

The relationship between the size of the enlarged ends 14 and 15 of the cross member 13 relative to the size of the central portion 16 can be significant in determining the relative torsional stiffness of the vehicle frame assembly 10. It has been found that by varying the relationship between these sizes, the torsional stiffness of the cross member 13 can be adjusted to provide a desired torsional stiffness to the vehicle frame assembly. These relative sizes can be expressed in any conventional units, such as perimeter, diameter, and the like. Specifically, if the size of the enlarged ends 14 and 15 of the cross member 13 is relatively close to the size of the central portion 16, the torsional stiffness of the cross member 13 will be increased. As the size of the enlarged ends 14 and 15 of the cross member 13 is increased relative to the size of the central portion 16, the torsional stiffness of the cross member 13 will be decreased. Similarly, the wall thickness of the enlarged ends 14 and 15 and the central portion 16 of the cross member 13 can be significant in determining the relative torsional stiffness of the vehicle frame assembly 10. It has been found that the torsional stiffness of the cross member 13 increases with the wall thickness of the enlarged ends 14 and 15 and the central portion 16 thereof.

As best shown in FIG. 3, the cross member 13 is inserted in the openings 20*a* and 20*b* such that the enlarged end 14 passes through the inside wall 21 of the side rail 12 until its outer edge 19 extends slightly beyond with the outside wall 22 of the side rail 12. The cross member 13 is then secured to the side rail 12, such as by welding 23. The welding 23 may extend completely about the enlarged end 14 of the cross member 13 or may extend discontinuously thereabout. Preferably, the welding 23 is made between the inside wall 21 of the side rail 12 and the enlarged end 14 of the cross member 13 and also between the outside wall 22 of the side rail 12 and the enlarged end of the cross member 13, although such is not necessary. Alternatively, is the cross member 13 may be secured to the side rail 12 using other known methods, such as adhesives. The other enlarged end 15 of the cross member 13 can be secured to the side rail 11 in a similar manner.

Figure 4:
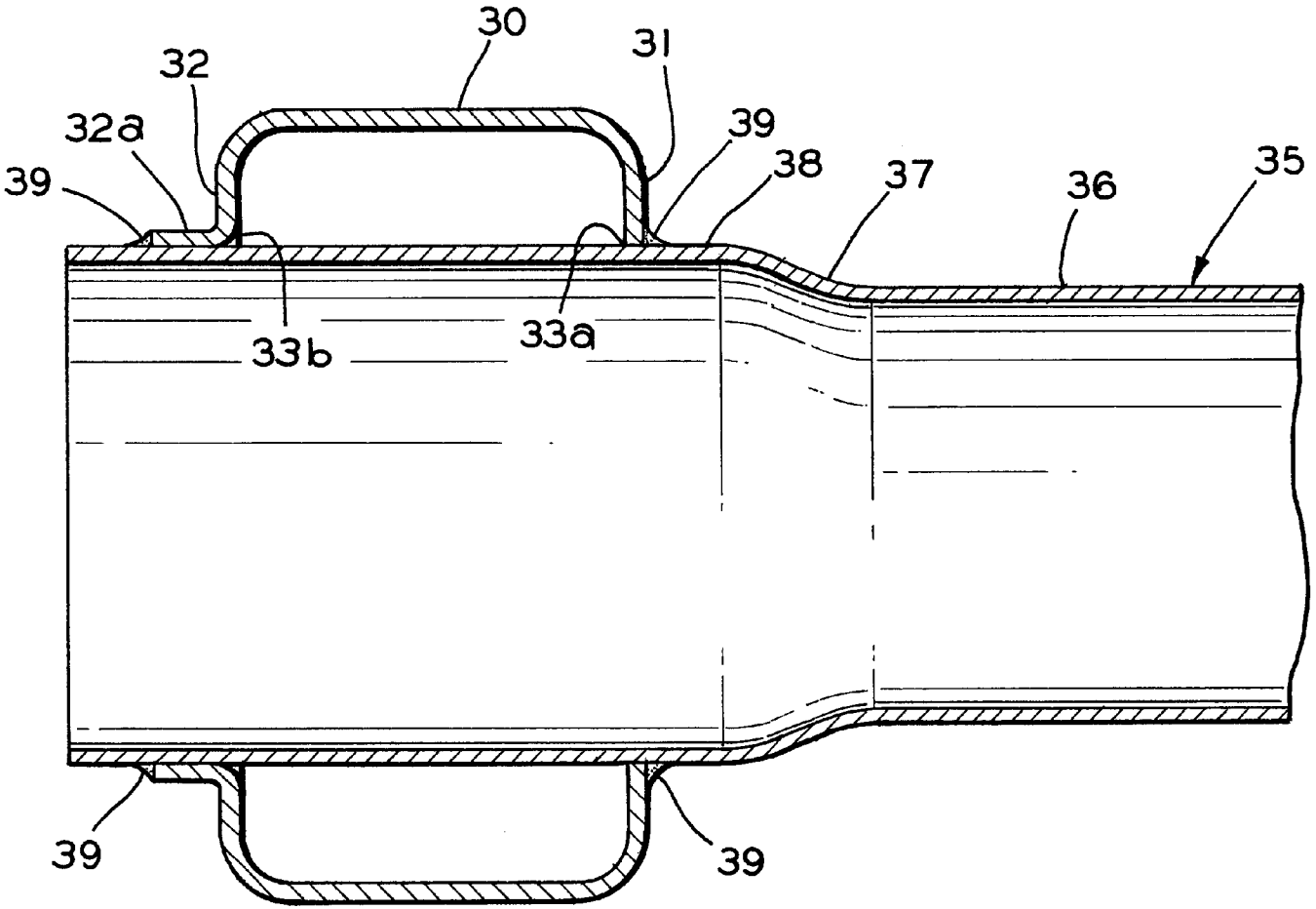
FIG. 4 is a sectional elevational view similar to FIG. 3 of a second embodiment of a joint between the cross member and the side rail illustrated in FIG. 1.

Referring now to FIG. 4, there is illustrated a second embodiment of a joint between a cross member and a side rail of the vehicle frame assembly 10 in accordance with this invention. In this embodiment, a modified side rail 30 is provided in lieu of the side rail 12. The modified side rail 30 is formed having an inside wall 31 and an outside wall 32. Respective openings 33*a* and 33*b* are formed through the inside wall 31 and the outside wall 32 of the side rail 30. The outside wall 32 further has a relatively short flange portion 32*a* formed about the opening 33*b*. A modified cross member, indicated generally at 35, is provided in lieu of the cross member 13. The modified cross member 35 includes a central portion 36, a transition portion 37, and an enlarged end 38. The enlarged end 38 of the cross member 35 extends through the openings 33*a* and 33*b* and through the flange portion 32*a*. The openings 33*a* and 33*b* and the flange portion 32*a* are shaped to correspond to the cross sectional shape of the enlarged end 38 of the cross member 35 and is slightly larger in size. The cross member 35 is then secured to the side rail 30, such as by welding 39. The flange portion 32*a* improves the welding process and can facilitate assembly of the cross member 35 with the side rail 30.

Figure 5:
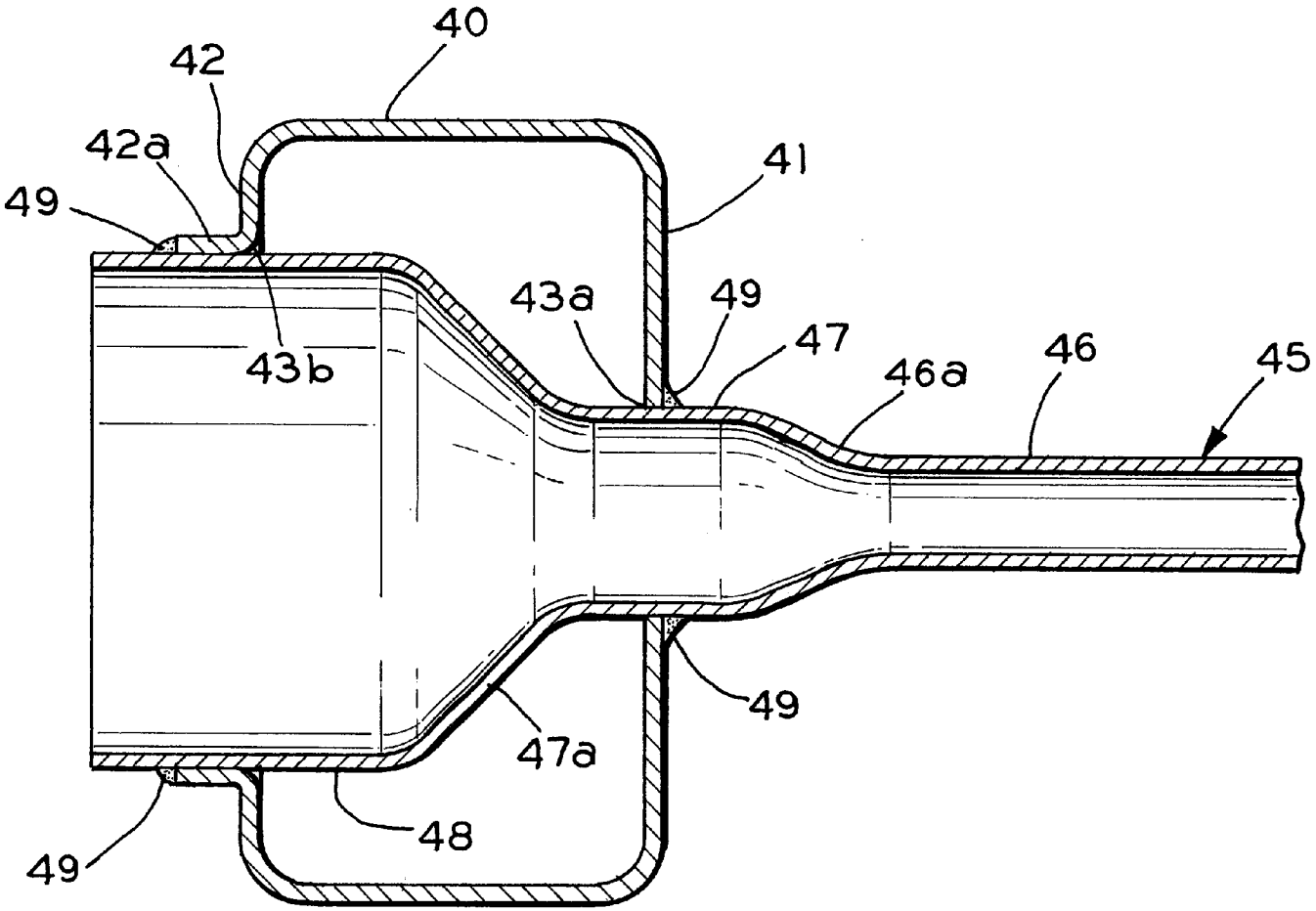
FIG. 5 is a sectional elevational view similar to FIG. 3 of a third embodiment of a joint between the cross member and the side rail illustrated in FIG. 1.

Referring now to FIG. 5, there is illustrated a third embodiment of a joint between a cross member and a side rail of the vehicle frame assembly 10 in accordance with this invention. In this embodiment, a modified side rail 40 is provided in lieu of the side rail 12. The modified side rail 40 is formed having an inside wall 41 and an outside wall 42. Respective openings 43*a* and 43*b* are formed through the inside wall 41 and the outside wall 42 of the side rail 40. The opening 43*a* formed through the inside wall 41 is relatively small in size, while the opening 43*b* formed through the outside wall 42 is relatively large. The outside wall 42 further has a relatively short flange portion 42*a* formed about the opening 43*b*. A modified cross member, indicated generally at 45, is provided in lieu of the cross member 13. The modified cross member 45 includes a central portion 46, a first transition portion 46*a*, an enlarged intermediate portion 47, a second transition portion 47*a*, and a further enlarged end 48. The enlarged end 48 of the cross member 45 extends through the flange portion 42*a* and through the opening 43*b* formed through the outside wall 42. The intermediate portion 47 extends through the opening 43*a* formed through the inside wall 41. The opening 43*b* and the flange portion 42*a* are shaped to correspond to the cross sectional shape of the enlarged end 48 of the cross member 45 and are slightly larger in size. Similarly, the opening 43*a* is shaped to correspond to the cross sectional shape of the intermediate portion 47 of the cross member 45 and is also slightly larger in size. The cross member 45 is then secured to the side rail 40, such as by welding 49.

Figure 6:
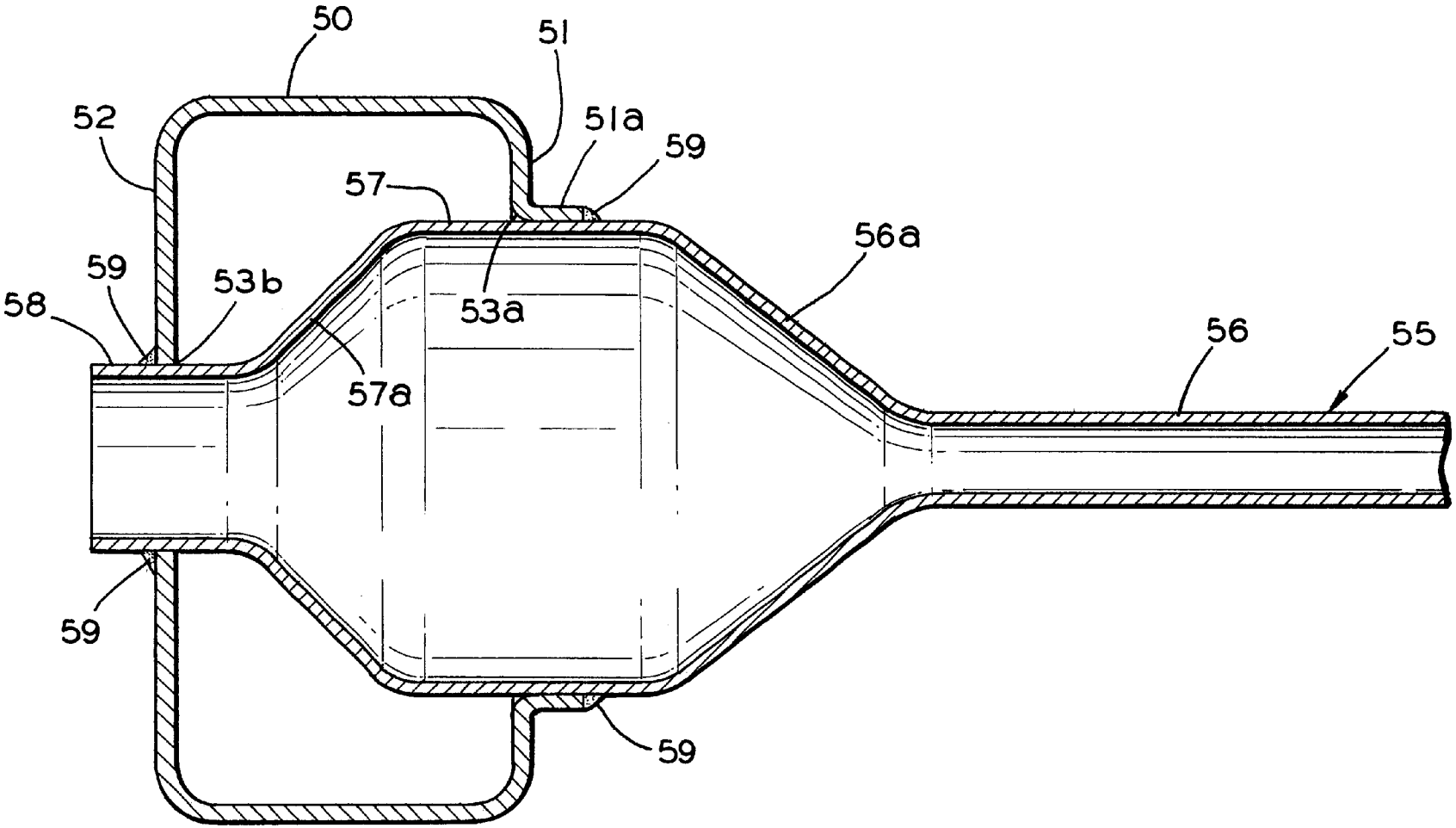
FIG. 6 is a sectional elevational view similar to FIG. 3 of a fourth embodiment of a joint between the cross member and the side rail illustrated in FIG. 1.

Referring now to FIG. 6, there is illustrated a fourth embodiment of a joint between a cross member and a side rail of the vehicle frame assembly 10 in accordance with this invention. In this embodiment, a modified side rail 50 is provided in lieu of the side rail 12. The modified side rail 50 is formed having an inside wall 51 and an outside wall 52. Respective openings 53*a* and 53*b* are formed through the inside wall 51 and the outside wall 52 of the side rail 50. The opening 53*a* formed through the inside wall 51 is relatively large in size, while the opening 53*b* formed through the outside wall 52 is relatively small. The inside wall 51 further has a relatively short flange portion 51*a* formed about the opening 53*a*. A modified cross member, indicated generally at 55, is provided in lieu of the cross member 13. The modified cross member 55 includes a central portion 56, a first transition portion 56*a*, an enlarged intermediate portion 57, a second transition portion 57*a*, and an end 58 that is somewhat smaller than the intermediate portion 57 but larger than the central portion 56. The end 58 of the cross member 55 extends through the opening 53*b* formed through the outside wall 52. The intermediate portion 57 extends through the flange portion 51*a* and the opening 53*a* formed through the inside wall 51. The opening 53*b* is shaped to correspond to the cross sectional shape of the end 58 of the cross member 55 and is slightly larger in size. Similarly, the opening 53*a* is shaped to correspond to the cross sectional shape of the flange portion 51*a* and the intermediate portion 57 of the cross member 55 and are also slightly larger in size. The cross is member 55 is then secured to the side rail 50, such as by welding 59.

Figure 7:
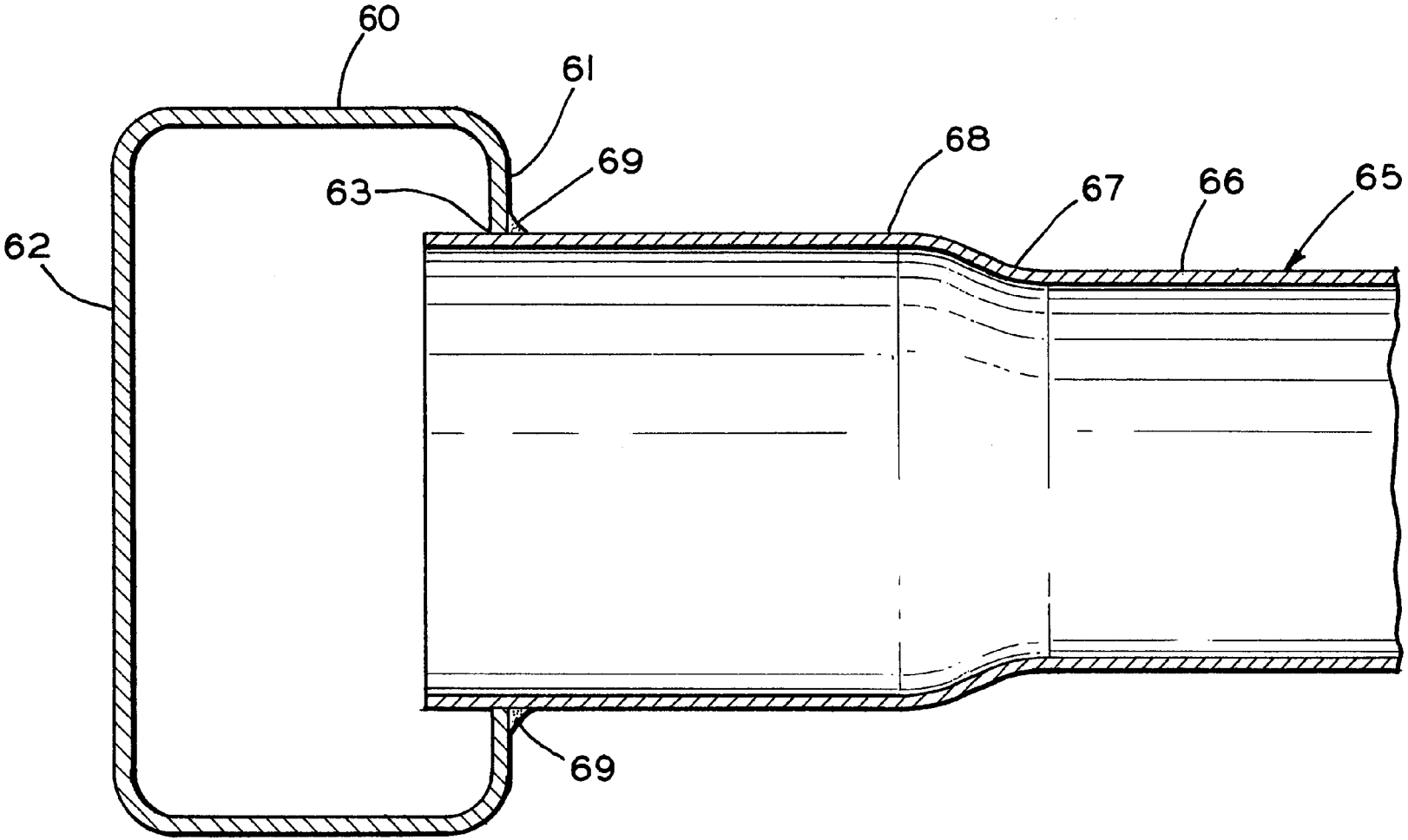
FIG. 7 is a sectional elevational view similar to FIG. 3 of a fifth embodiment of a joint between the cross member and the side rail illustrated in FIG. 1.

Referring now to FIG. 7, there is illustrated a fifth embodiment of a joint between a cross member and a side rail of the vehicle frame assembly 10 in accordance with this invention. In this embodiment, a modified side rail 60 is provided in lieu of the side rail 12. The modified side rail 60 is formed having an inside wall 61 and an outside wall 62. An opening 63 is formed through the inside wall 61 of the side rail 60. A modified cross member, indicated generally at 65, is provided in lieu of the cross member 13. The modified cross member 65 includes a central portion 66, a transition portion 67, and an enlarged end 68. The enlarged end 68 of the cross member 65 extends through the opening 63 formed through the inside wall 61 and terminates in the interior of the side rail 60. The opening 63 is shaped to correspond to the cross sectional shape of the enlarged end 68 of the cross member 65 and is slightly larger in size. The cross member 65 is then secured to the side rail 60, such as by welding 69.

Figure 8:
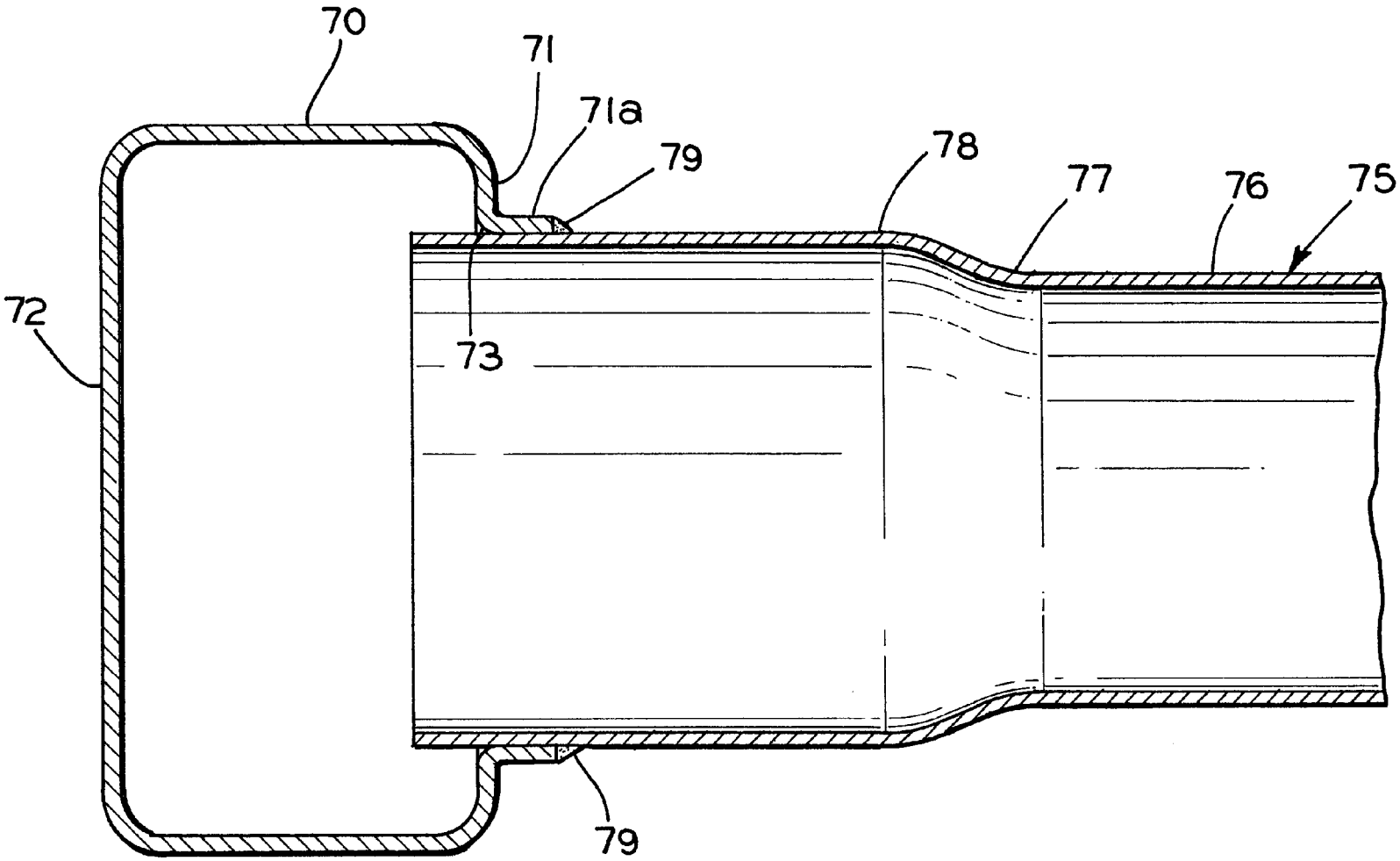
FIG. 8 is a sectional elevational view similar to FIG. 3 of a sixth embodiment of a joint between the cross member and the side rail illustrated in FIG. 1.

Referring now to FIG. 8, there is illustrated a sixth embodiment of a joint between a cross member and a side rail of the vehicle frame assembly 10 in accordance with this invention. In this embodiment, a modified side rail 70 is provided in lieu of the side rail 12. The modified side rail 70 is formed having an inside wall 71 and an outside wall 72. An opening 73 is formed through the inside wall 71 of the side rail 70. The inside wall 71 further has a relatively short flange portion 71*a* formed about the opening 73. A modified cross member, indicated generally at 75, is provided in lieu of the cross member 13. The modified cross member 75 includes a central portion 76, a transition portion 77, and an enlarged end 78. The enlarged end 78 of the cross member 75 extends through the opening 73 formed through the inside wall 71 and the flange 71*a* and terminates in the interior of the side rail 70. The opening 73 and the flange 71*a* are shaped to correspond to the cross sectional shape of the enlarged end 78 of the cross member 75 and are slightly larger in size. The cross member 75 is then secured to the side rail 70, such as by welding 79.

Figure 9:
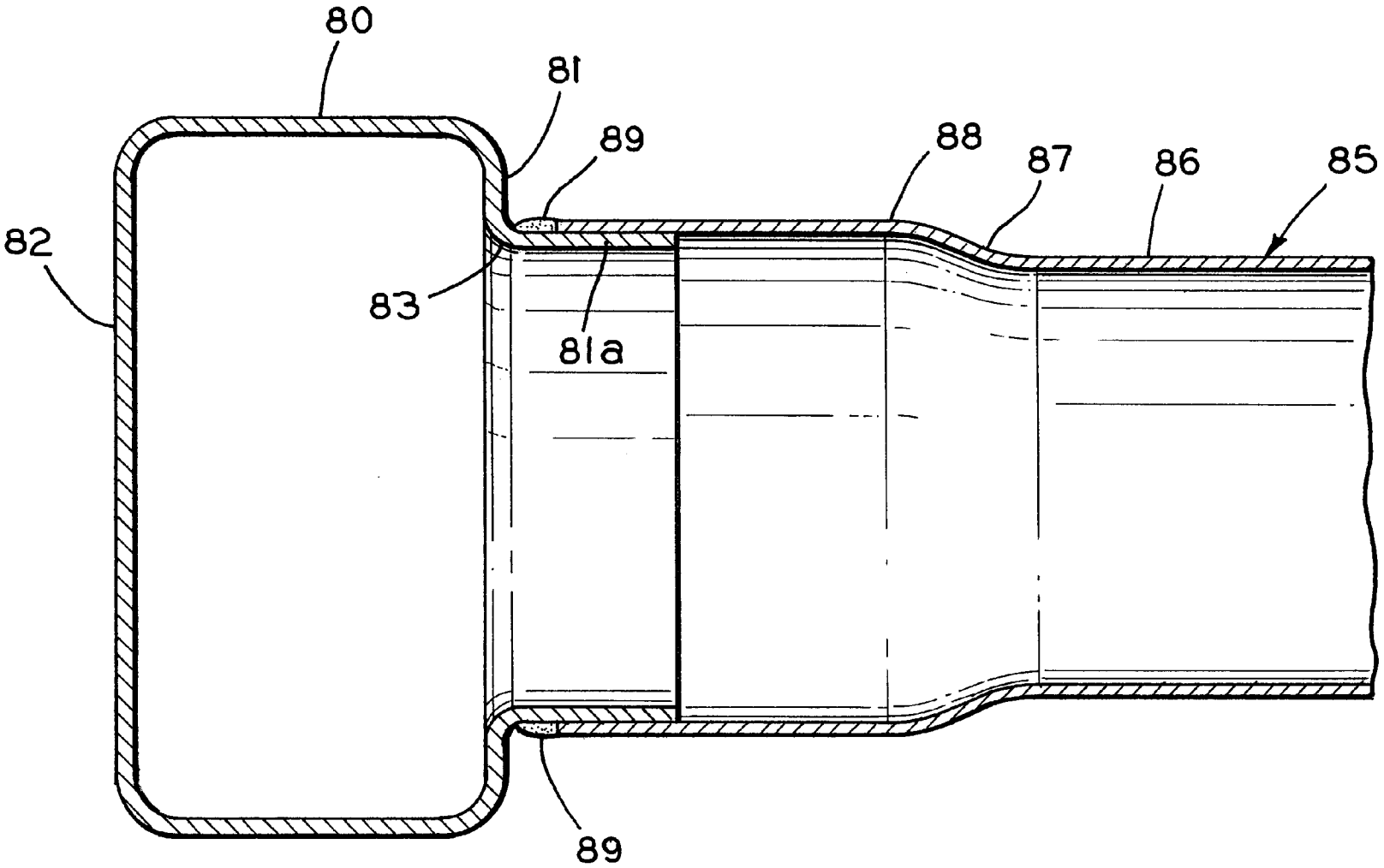
FIG. 9 is a sectional elevational view similar to FIG. 3 of a seventh embodiment of a joint between the cross member and the side rail illustrated in FIG. 1.

Referring now to FIG. 9, there is illustrated a seventh embodiment of a joint between a cross member and a side rail of the vehicle frame assembly 10 in accordance with this invention. In this embodiment, a modified side rail 80 is provided in lieu of the side rail 12. The modified side rail 80 is formed having an inside wall 81 and an outside wall 82. An opening 83 is formed through the inside wall 81 of the side rail 80. The inside wall 81 further has a relatively short flange portion 81*a* formed about the opening 83. A modified cross member, indicated generally at 85, is provided in lieu of the cross member 13. The modified cross member 85 includes a central portion 86, a transition portion 87, and an enlarged end 88. The enlarged end 88 of the cross member 85 extends about the flange 81*a*. The flange 81*a* is shaped to correspond to the cross sectional shape of the enlarged end 88 of the cross member 85 and are slightly smaller in size. The cross member 85 is then secured to the side rail 80, such as by welding 89.

Figure 10:
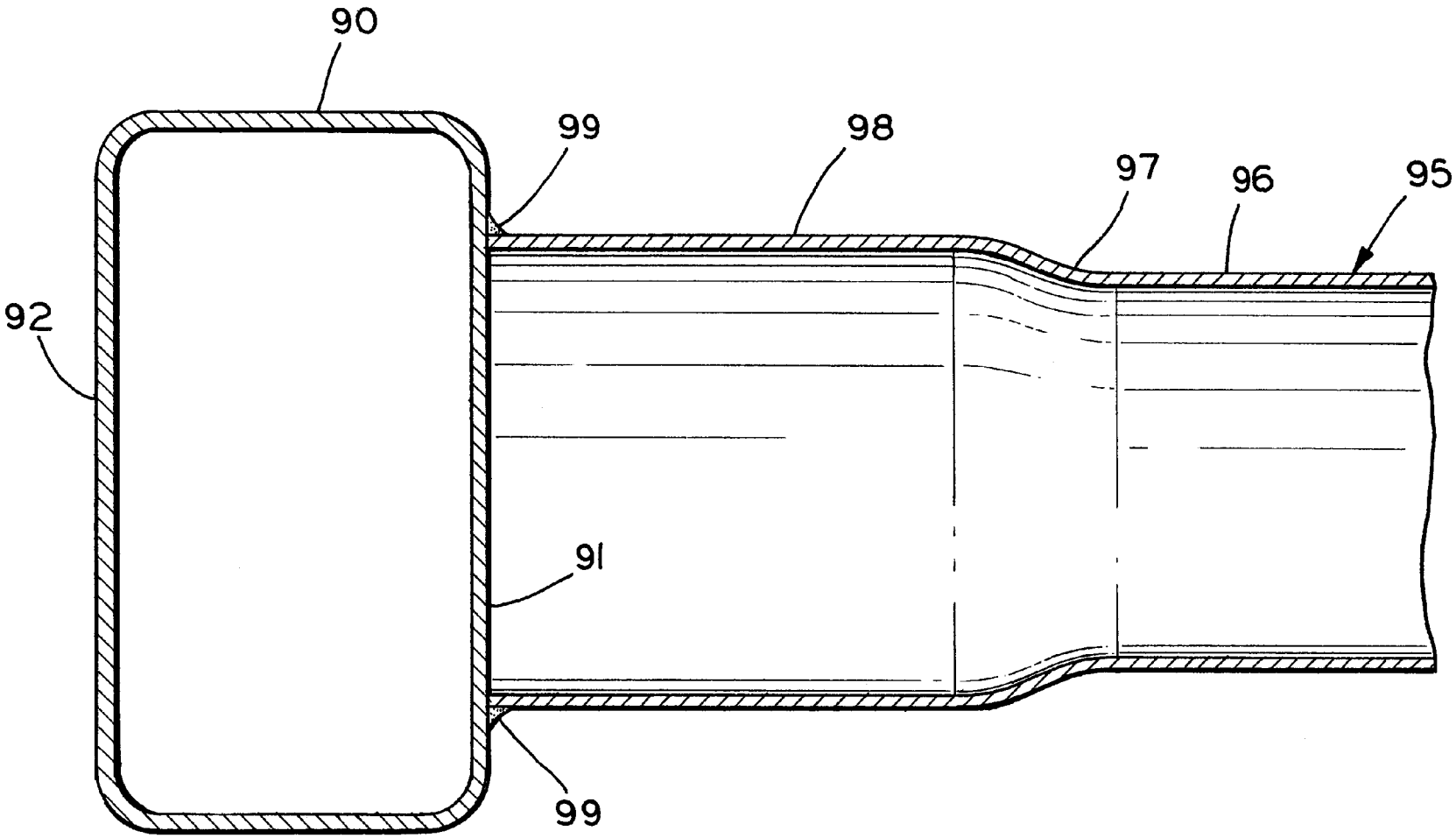
FIG. 10 is a sectional elevational view similar to FIG. 3 of a eighth embodiment of a joint between the cross member and the side rail illustrated in FIG. 1.

Referring now to FIG. 10, there is illustrated an eighth embodiment of a joint between a cross member and a side rail of the vehicle frame assembly 10 in accordance with this invention. In this embodiment, a modified side rail 90 is provided in lieu of the side rail 12. The modified side rail 90 is formed having an inside wall 91 and an outside wall 92. A modified cross member, indicated generally at 95, is provided in lieu of the cross member 13. The modified cross member 95 includes a central portion 96, a transition portion 97, and an enlarged end 98. The enlarged end 98 of the cross member 95 extends into abutment with the inside wall 91. The cross member 95 is then secured to the side rail 90, such as by welding 99.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A method of manufacturing a vehicle frame assembly comprising the steps of:

(a) providing first and second side rails;

(b) providing first and second cross members, each of the first and second cross members having first and second ends extending from a central portion;

(c) determining a desired torsional stiffness for the first cross member;

(d) in response to said determination, enlarging the first and second ends of the first cross member so as to achieve the desired torsional stiffness for the cross member; and (e) securing the first ends of the first and second cross members to the first side rail and the second ends of the first and second cross members to the second side rail to form a vehicle frame assembly.

2. The method defined in claim 1 wherein said step (d) is performed by hydroforming.

3. The method defined in claim 1 wherein said step (d) is performed by increasing the perimeter of the first and second ends of the first cross member.

4. The method defined in claim 1 wherein said step (d) is performed by increasing the size of the first and second ends of the first cross member from about 5% to about 50%.

5. The method defined in claim 1 wherein said step (d) is performed by decreasing the wall thickness of the first and second ends of the first cross member.

6. The method defined in claim 1 wherein said step (e) is performed by forming an opening through each of the first and second side rails and inserting the first and second ends of the first cross member respectively through the openings.

7. The method defined in claim 6 wherein said step (e) is performed by forming a flange about each of the openings and inserting the first and second ends of the cross member within the flanges.

8. The method defined in claim 6 wherein said step (e) is performed by forming a flange about each of the openings and inserting the first and second ends of the cross member about the flanges.

9. The method defined in claim 1 wherein said step (e) is performed by forming first and second openings through each of the first and second side rails and inserting the first and second ends of the first cross member respectively through the first and second openings.

10. The method defined in claim 9 wherein said step (e) is performed by forming a flange about the first openings formed through the first and second side rails and inserting the first and second ends of the cross member within the flanges.

11. The method defined in claim 9 wherein said step (e) is performed by forming a flange about the first openings formed through the first and second side rails and inserting the first and second ends of the cross member about the flanges.

12. The method defined in claim 7 wherein said step (e) is performed by forming the first and second openings having different sizes.

13. The method defined in claim 1 wherein said step (e) is performed by disposing the first and second ends of the cross member in abutment with the first and second side rails.

14. The method defined in claim 1 wherein said step (e) is performed by welding.

* * * * *